US011753834B2

(12) United States Patent
Ferreira

(10) Patent No.: US 11,753,834 B2
(45) Date of Patent: Sep. 12, 2023

(54) FORMWORK SYSTEMS AND RELATED METHODS

(71) Applicant: Premform Limited, Brampton (CA)

(72) Inventor: Manuel Ferreira, Brampton (CA)

(73) Assignee: PREMFORM LIMITED, Brampton (CA)

( * ) Notice: Subject to any disclaimer, the term of this patent is extended or adjusted under 35 U.S.C. 154(b) by 0 days.

(21) Appl. No.: 17/450,301

(22) Filed: Oct. 8, 2021

(65) Prior Publication Data

US 2022/0112733 A1 Apr. 14, 2022

Related U.S. Application Data

(60) Provisional application No. 63/091,684, filed on Oct. 14, 2020.

(51) Int. Cl.

| | |
|---|---|
| ***E04G 17/14*** | (2006.01) |
| ***E04G 19/00*** | (2006.01) |
| ***E04G 21/26*** | (2006.01) |
| ***E04G 25/06*** | (2006.01) |
| ***E04G 17/00*** | (2006.01) |
| *E04G 25/00* | (2006.01) |

(52) U.S. Cl.

CPC ..... *E04G 17/14* (2013.01); *E04G 17/002* (2013.01); *E04G 19/003* (2013.01); *E04G 21/26* (2013.01); *E04G 25/063* (2013.01); *E04G 2025/006* (2013.01)

(58) Field of Classification Search

CPC ..... E04G 17/14; E04G 19/003; E04G 25/063; E04G 17/002; E04H 4/005

See application file for complete search history.

(56) References Cited

U.S. PATENT DOCUMENTS

| | | | | |
|---|---|---|---|---|
| 3,030,061 | A | 2/1961 | Jennings | |
| 3,798,856 | A | 3/1974 | Gloskowski | |
| 2006/0201743 | A1* | 9/2006 | Dell'Erba | E04G 17/14 182/82 |
| 2006/0207215 | A1* | 9/2006 | Bruno | E04G 17/14 52/745.12 |
| 2008/0173788 | A1 | 7/2008 | Brewka et al. | |

FOREIGN PATENT DOCUMENTS

| | | | | |
|---|---|---|---|---|
| CA | 1329492 C | * | 5/1994 | E04G 17/14 |
| CA | 2770163 A1 | * | 8/2013 | B65D 90/047 |
| CN | 110644774 A | * | 1/2020 | E04G 11/08 |
| CN | 112696012 A | * | 4/2021 | E04G 11/08 |

(Continued)

OTHER PUBLICATIONS

European Search Report dated Mar. 4, 2022 in respect of European Application No. 21201883.2.

*Primary Examiner* — Michael Safavi

(57) ABSTRACT

A formwork system includes (a) a wallform panel for forming a wall portion; and (b) at least one brace assembly including a pair of vertically spaced apart props pivotably connected to the wallform panel for pivoting of the brace assembly relative to the wallform panel between a storage position, in which the brace assembly lies adjacent the wallform panel, and a deployed position, in which the brace assembly projects from the wallform panel for anchoring the props to a ground surface through a common base plate connected to each prop.

19 Claims, 4 Drawing Sheets

(56) References Cited

FOREIGN PATENT DOCUMENTS

| | | | | | |
|---|---|---|---|---|---|
| CN | 112727070 | A | * | 4/2021 | ..... E04G 11/08 |
| DE | 2142150 | A1 | * | 3/1972 | ..... E04G 17/14 |
| DE | 2344947 | A | * | 4/1975 | ..... E04G 17/002 |
| DE | 2344947 | A1 | | 4/1975 | |
| DE | 102012219931 | A1 | * | 4/2014 | ..... E04G 17/0658 |
| EP | 3418473 | A1 | | 12/2018 | |
| ES | 2301305 | A1 | | 6/2008 | |
| FR | 1475899 | A | * | 4/1967 | ..... E04G 17/14 |
| FR | 2325783 | | | 4/1977 | |
| FR | 2580019 | A | * | 10/1986 | ..... E04G 17/14 |
| FR | 2688816 | A1 | * | 9/1993 | ..... E04G 13/02 |
| FR | 2776004 | A1 | * | 9/1999 | ..... E04G 17/002 |
| FR | 2802958 | A1 | * | 6/2001 | ..... E04G 17/14 |
| FR | 2884536 | A1 | * | 10/2006 | ..... E04G 11/14 |
| FR | 3045087 | B1 | * | 5/2021 | ..... E04G 11/06 |
| GB | 722606 | | | 1/1955 | |
| GB | 2598125 | A | * | 2/2022 | ..... E04G 11/28 |
| KR | 20100039916 | A | * | 4/2010 | ..... E04G 17/14 |
| KR | 101320700 | B1 | * | 10/2013 | ..... E04G 17/14 |
| WO | 83002794 | A1 | | 8/1983 | |
| WO | WO-8302794 | A1 | * | 8/1983 | ..... E04G 17/14 |
| WO | WO-2009004509 | A1 | * | 1/2009 | ..... E04G 17/002 |
| WO | 2011040807 | A1 | | 4/2011 | |
| WO | WO-2021099810 | A1 | * | 5/2021 | |

* cited by examiner

FORMWORK SYSTEMS AND RELATED METHODS

CROSS-REFERENCE TO RELATED APPLICATIONS

This application claims the benefit of U.S. Provisional Application No. 63/091,684, filed Oct. 14, 2020, the entirety of which is hereby incorporated herein by reference.

FIELD

The specification relates generally to formation of walls from pourable building material, and more specifically, to formwork systems with brace assemblies for supporting and aligning wallform panels.

BACKGROUND

U.S. Pat. No. 3,798,856 (Gloskowski) discloses a temporary brace assembly for a tilt-up wall panel during construction arranged to hold the wall panel in the vertical position after which, through the use of a universal joint at the point of connection of the brace to the wall panel, by rotating the brace about its longitudinal axis, it can be removed and disattached from the panel by a person at the floor level.

International Pub. No. WO83/002794 (Mcgrath) discloses a prop body having, in addition to its telescopically adjustable outer section and inner section, a screw threadedly engaged in the distal end of the inner section. Sole plates are connected to the ends of the body, one sole plate being connected rotatably to the outer telescopic section, the other sole plate being non-rotatably connected to the screw. With the screw held against rotation of its sole plate, the telescopic sections can be rotated in one direction or the other for screw-threaded extension or retraction of the prop body. Either or each sole plate may be connected to the prop body by a universal joint so the prop can be used as a compression or tension member between surfaces to one or both of which it is oblique.

SUMMARY

The following summary is intended to introduce the reader to various aspects of the applicant's teaching, but not to define any invention.

According to some aspects, a formwork system includes: (a) a wallform panel having a first side for forming a concrete wall portion and a second side opposite the first side; and (b) at least one brace assembly mounted to the second side of the wallform panel for supporting and aligning the wallform panel. The brace assembly includes: (i) a base plate for anchoring to a ground surface spaced horizontally apart from the wallform panel, (ii) a pair of vertically spaced apart swivel connectors pivotably mounted to the second side of the wallform panel for pivoting about a vertical axis relative to the wallform panel, and (iii) a pair of vertically spaced apart props. Each prop has an adjustable length between a first end and a second end. The first end of each prop is pivotably connected to the base plate and the second end of each prop is pivotably connected to a corresponding swivel connector. The props are fixed to pivot with the swivel connectors about the vertical axis for swinging the brace assembly between a deployed position, in which the brace assembly projects from the wallform panel for anchoring the base plate and supporting the wallform panel upright, and a storage position, in which the brace assembly lies adjacent the wallform panel.

In some examples, each swivel connector is pivotably connected to the wallform panel through a vertical pivot pin extending along the vertical axis through the swivel connector and a mount detachably secured to a frame of the wallform panel.

In some examples, the first end of each prop is pivotably connected to the base plate through a corresponding first horizontal pivot pin, and the second end of each prop is pivotably connected to a corresponding swivel connector through a corresponding second horizontal pivot pin.

In some examples, a locking mechanism is provided and operable to selectively lock the brace assembly in either of the deployed position and the storage position, and unlock the brace assembly for swinging between the deployed and storage positions.

In some examples, the locking mechanism includes a removable locking pin insertable through a swivel aperture in the swivel connector and one of (i) a deployed-position aperture fixed relative to the wallform panel and in alignment with the swivel aperture when the brace assembly is in the deployed position, and (ii) a storage-position aperture fixed relative to the wallform panel and in alignment with the swivel aperture when the brace assembly is in the storage position.

In some examples, each prop comprises a turnbuckle mechanism for adjusting the length.

According to some aspects, a formwork system includes: (a) a wallform panel for forming a wall portion; and (b) at least one brace assembly comprising a pair of vertically spaced apart props pivotably connected to the wallform panel for pivoting of the brace assembly relative to the wallform panel between a storage position, in which the brace assembly lies adjacent the wallform panel, and a deployed position, in which the brace assembly projects from the wallform panel for anchoring the props to a ground surface through a common base plate connected to each prop. In some examples, at least one of the props has an adjustable length for aligning the wallform panel.

According to some aspects, a brace assembly for supporting and aligning a wallform panel includes: (a) a base plate for anchoring to a ground surface spaced horizontally apart from the wallform panel; (b) a pair of vertically spaced apart swivel connectors pivotably connectable to the wallform panel for pivoting about a vertical axis relative to the wallform panel; and (c) a pair of vertically spaced apart props. Each prop extends between a first end connected to the base plate and a second end connected to a corresponding swivel connector. The props are fixed to pivot with the swivel connectors about the vertical axis for swinging the brace assembly between a deployed position, in which the brace assembly projects from the wallform panel, and a storage position, in which the brace assembly lies adjacent the wallform panel.

In some examples, least one of the props has an adjustable length between the first and second ends.

In some examples, each swivel connector is pivotably connectable to the wallform panel through a vertical pivot pin passing through the swivel connector and a corresponding mount detachably securable to a frame of the wallform panel.

In some examples, a locking mechanism is provided and operable to selectively lock the brace assembly in at least one of the deployed position and the storage position, and unlock the brace assembly for swinging between the deployed and storage positions. In some examples, the locking mechanism is operable to selectively lock the brace assembly relative to the wallform panel in the deployed position and in the storage position.

According to some aspects, a swivel apparatus for a brace assembly connectable to a wallform panel includes: (a) a mount detachably securable to a frame of the wallform panel; (b) a swivel connector having a first joint portion pivotably connected to the mount for pivoting of the swivel connector about a vertical axis relative to the mount and a second joint portion pivotably connectable to a prop of the brace assembly for pivoting of the prop about a horizontal axis relative to the swivel connector and for pivoting of the prop with the swivel connector about the vertical axis to swing the brace assembly between a deployed position in which the brace assembly projects from the wallform panel and a storage position in which the brace assembly lies adjacent the wallform panel; and (c) a locking mechanism operable to selectively lock the swivel connector relative to the mount for inhibiting pivoting of the swivel connector about the vertical axis when the brace assembly is in the deployed position and when the brace assembly is in the storage position, and to unlock the swivel connector relative to the mount to permit swinging of the brace assembly between the deployed and storage positions.

In some examples, the swivel connector is pivotably connected to the mount through a vertical pivot pin extending along the vertical axis.

In some examples, the locking mechanism comprises a removable locking pin insertable through a swivel aperture in the swivel connector and one of (i) a deployed-position aperture in the mount and in alignment with the swivel aperture when the brace assembly is in the deployed position, and (ii) a storage-position aperture in the mount and in alignment with the swivel aperture when the brace assembly is in the storage position. In some examples, each of the swivel aperture, the deployed-position aperture, and the storage-position aperture extends parallel with and is spaced horizontally apart from the vertical axis. In some examples, the storage-position aperture is spaced apart from the deployed-position aperture by about 90 degrees about the vertical axis.

According to some aspects, a method of operating a formwork system includes: (a) positioning the formwork system upright. The formwork system includes a wallform panel and a brace assembly pivotably connected to the wallform panel, the brace assembly including a pair of vertically spaced apart props, and each prop having a first end pivotably connected to the wallform panel and a second end connected to a base plate of the brace assembly. The method further includes (b) swinging the brace assembly relative to the wallform panel from a storage position to a deployed position; (c) when the brace assembly is in the deployed position, anchoring the base plate to a ground surface spaced apart from the wallform panel; after (c), adjusting a length of at least one of the props to align the wallform panel; after (d), unanchoring the base plate from the ground surface; and after (e), swinging the brace assembly from the deployed position back to the storage position.

In some examples, the method further includes, prior to (b), unlocking the brace assembly from the storage position, and after (f), locking the brace assembly in the storage position.

In some examples, the method further includes, prior to (c), locking the brace assembly in the deployed position, and prior to (f), unlocking the brace assembly from the deployed position.

In some examples, the method further includes, after (f), transporting the formwork system with the brace assembly in the storage position and pivotably connected to the wallform panel to a different location, and repeating steps (a) to (f) at the different location. In some examples, the different location comprises a different level of a multi-level building. In some examples, the method further includes, prior to repeating steps (a) to (f), storing the formwork system in a perimeter protection area of the multi-level building.

BRIEF DESCRIPTION OF THE DRAWINGS

The drawings included herewith are for illustrating various examples of apparatuses, systems, and methods of the present specification and are not intended to limit the scope of what is taught in any way. In the drawings.

DETAILED DESCRIPTION

Various apparatuses, systems, or processes will be described below to provide an example of an embodiment of each claimed invention. No embodiment described below limits any claimed invention and any claimed invention may cover systems, processes, or apparatuses that differ from those described below. The claimed inventions are not limited to systems, apparatuses, or processes having all of the features of any one system, apparatus, or process described below or to features common to multiple or all of the systems, apparatuses, or processes described below. It is possible that a system, apparatus, or process described below is not an embodiment of any claimed invention. Any invention disclosed in a system, apparatus, or process described herein that is not claimed in this document may be the subject matter of another protective instrument, for example, a continuing patent application, and the applicants, inventors, or owners do not intend to abandon, disclaim, or dedicate to the public any such invention by its disclosure in this document.

During wall formation, a pair of opposing wallform panels can be supported upright and tied together with a space therebetween for filling with a pourable building material, such as, for example, concrete. One or more outboard brace assemblies can be connected to one of the wallform panels to help support the panels upright. The brace assemblies can include one or more props extending between one end mounted to one of the wallform panels and an opposing end anchored to a ground surface spaced apart from the wallform panels. The props can have a length that is adjustable to facilitate positioning and alignment of the wallform panels supported by the brace assembly prior to pouring of the building material. In some examples, after the wall is formed, the brace assembly can be disconnected from the wallform panels and disassembled for temporary storage and/or transport to a different location (e.g. another level of a multi-story building) for formation of another wall portion.

According to some aspects of the present disclosure, adjustable formwork systems are disclosed that can facilitate deployment, take-down, storage, and/or transport of the formwork systems without necessarily requiring disconnection of the brace assemblies from the wallform panels. In some examples, this can facilitate a more space- and time-efficient, and in some cases safer, wall formation process relative to some other processes.

Figure 1A:
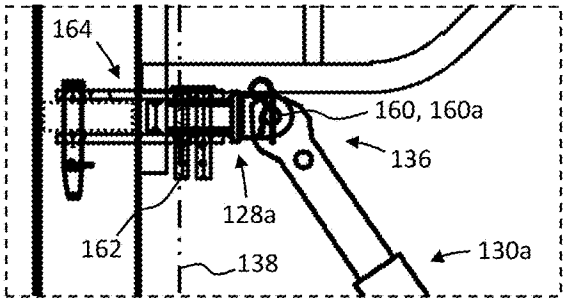
FIG. 1A is an enlarged view of an upper portion of the formwork system of FIG. 1.
Figure 1B:
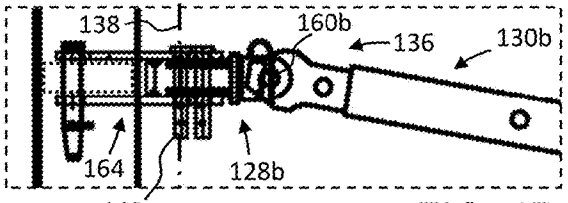
FIG. 1B is an enlarged view of a lower portion of the formwork system of FIG. 1.
Figure 1C:
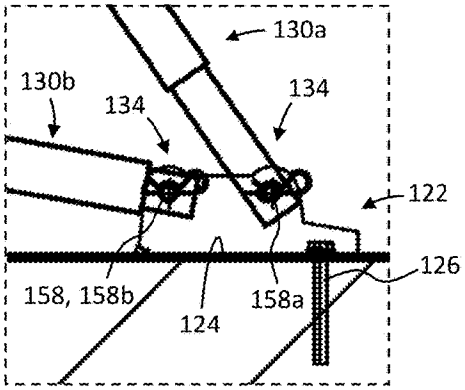
FIG. 1C is an enlarged view of an anchoring portion of the formwork system of FIG. 1.
Figure 1:
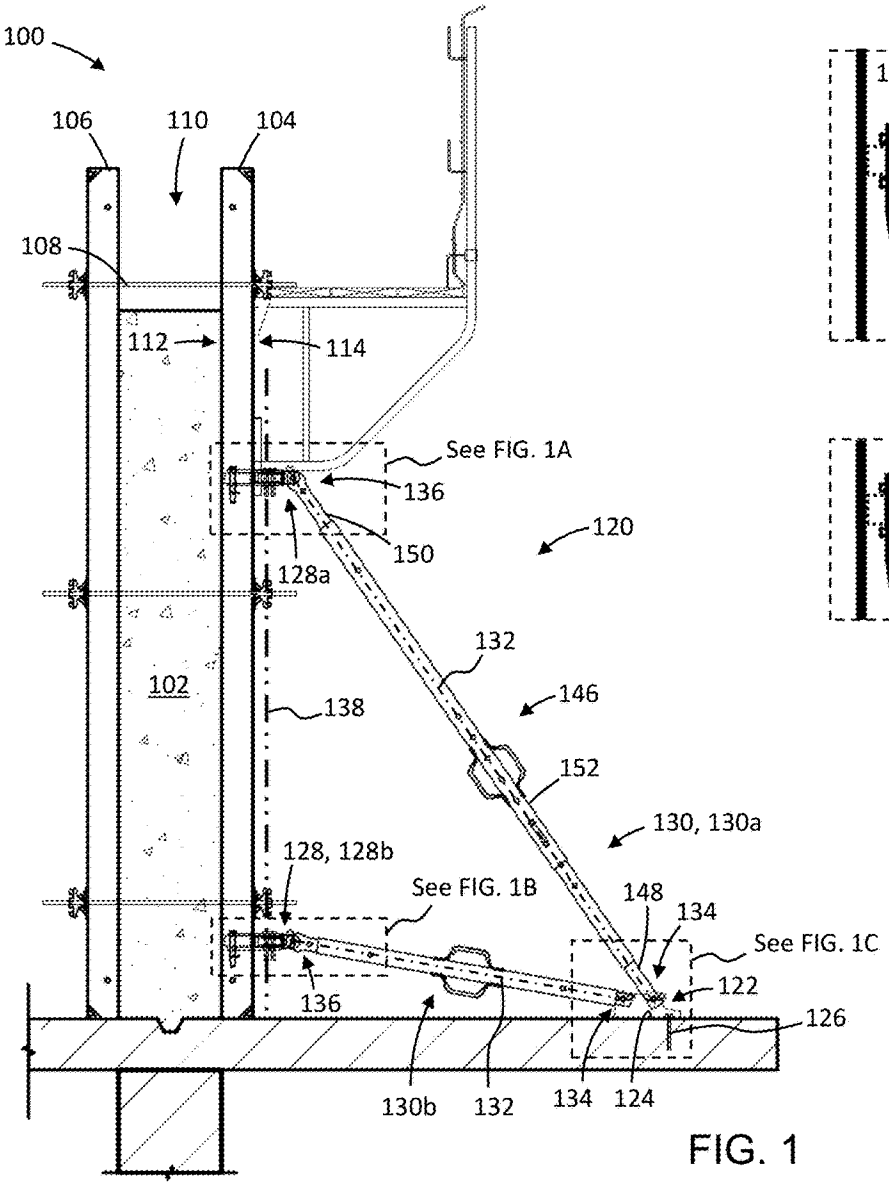
FIG. 1 is a side elevation schematic view of an example formwork system.
Figure 3:
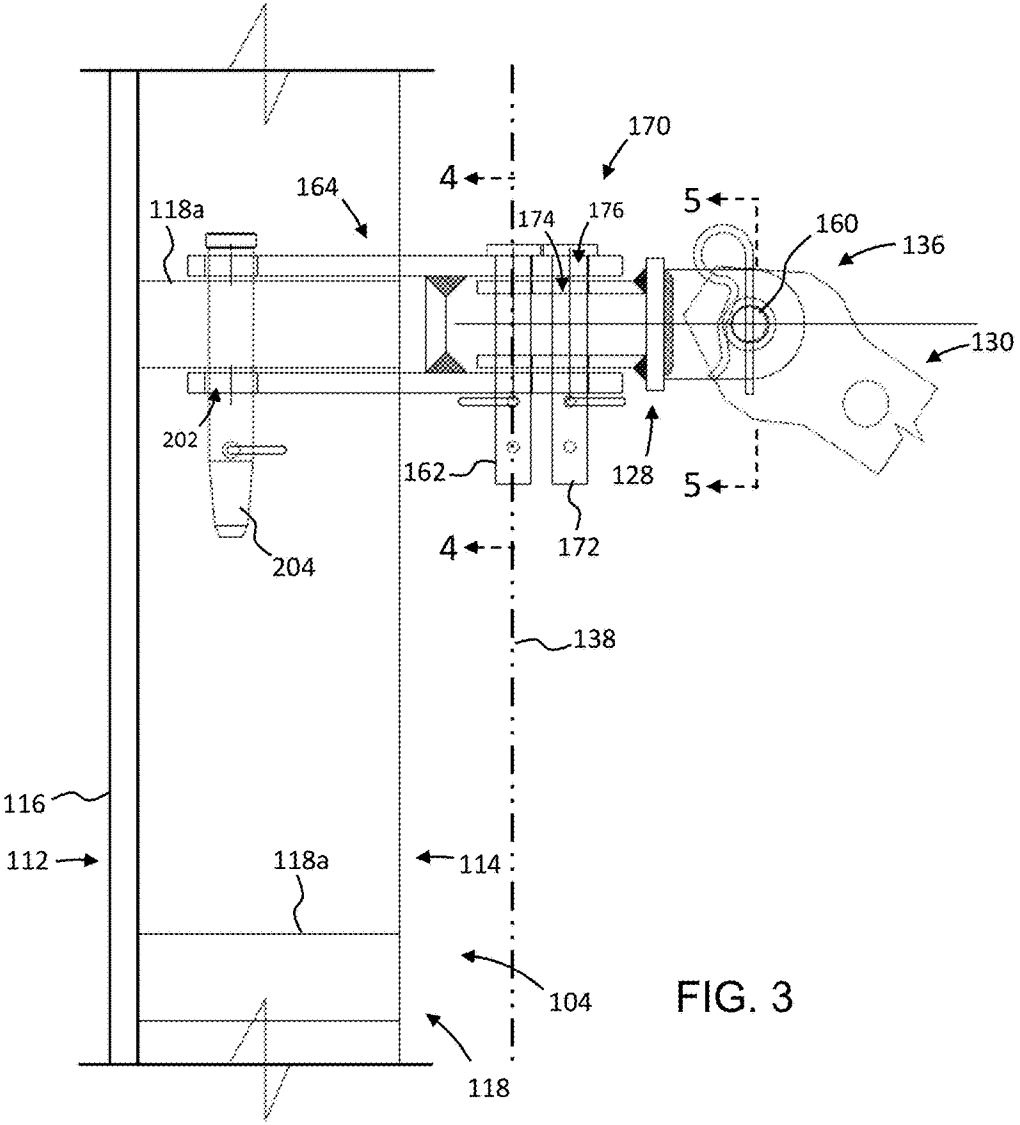
FIG. 3 is a detailed elevation view of brace assembly and wallform panel portions of the formwork system of FIG. 1.

Referring to FIG. 1, an example formwork system 100 for forming a wall portion 102 is illustrated. In the example illustrated, the formwork system 100 comprises a pair of parallel and opposing wallform panels, including a first wallform panel 104 and a second wallform panel 106 tied to the first wallform panel 104 through a plurality of ties 108. In the example illustrated, the first and second wallform panels 104, 106 are supported upright, and are spaced horizontally apart from each other by a space 110 fillable with concrete to form the wall portion 102. Each wallform panel 104, 106 has a first side 112 facing the space 110 for forming the wall portion 102 and a second side 114 opposite the first side 112. Referring to FIG. 3, in the example illustrated, each wallform panel 104, 106 has a form lining 116 on the first side 112 for forming a wall surface of the wall portion 102, and a frame 118 comprising a plurality of interconnected frame members 118*a* on the second side 114 and supporting the form lining 116.

Referring to FIG. 1, in the example illustrated, the formwork system 100 includes at least one brace assembly 120 on the second side 114 and mounted to the frame 118 of the wallform panel 104 for supporting the wallform panels 104, 106 upright during use. The formwork system 100 can include a plurality of brace assemblies 120 spaced horizontally apart from each other for supporting the wallform panels 104, 106.

In the example illustrated, the brace assembly 120 includes a base plate 122 for anchoring to a ground surface 124 spaced horizontally apart from the wallform panel 104, a pair of vertically spaced apart swivel connectors 128 pivotably mounted to the wallform panel 104, and a pair of vertically spaced apart props 130 for supporting and aligning the wallform panel 104. Each prop 130 extends along a prop axis 132 between a first end 134 connected to the base plate 122 and a second end 136 connected to a corresponding swivel connector 128.

In the example illustrated, the pair of swivel connectors 128 includes an upper swivel connector 128*a* and a lower swivel connector 128*b* below and in horizontal alignment with the upper swivel connector 128*b*. In the example illustrated, the pair of props 130 include an upper prop 130*a* and a lower prop 130*b* below and in horizontal alignment with the upper prop 130*a*. The upper prop 130*a* has its second end 136 connected to the wallform panel 104 through the upper swivel connector 128*a* and its first end 134 connected to the base plate 122, and the lower prop 130*b* has its second end 136 connected to the wallform panel through the lower swivel connector 128*b* and its first end 134 connected to the same base plate 122. Providing upper and lower props 130*a*, 130*b* connected to a common base plate 122 can help with stability of the wallform panel during deployment and use, and in some cases, can help provide for a more efficient and/or safer wall formation process, relative to providing, for example, a single prop or a pair of props anchored through separate base plates. In the example illustrated, the prop axis 132 of each prop 130 extends downwardly at an angle from the second end 136 (connected to the swivel connecter 128) to the first end 134 (connected to the base plate 122).

Figure 2:
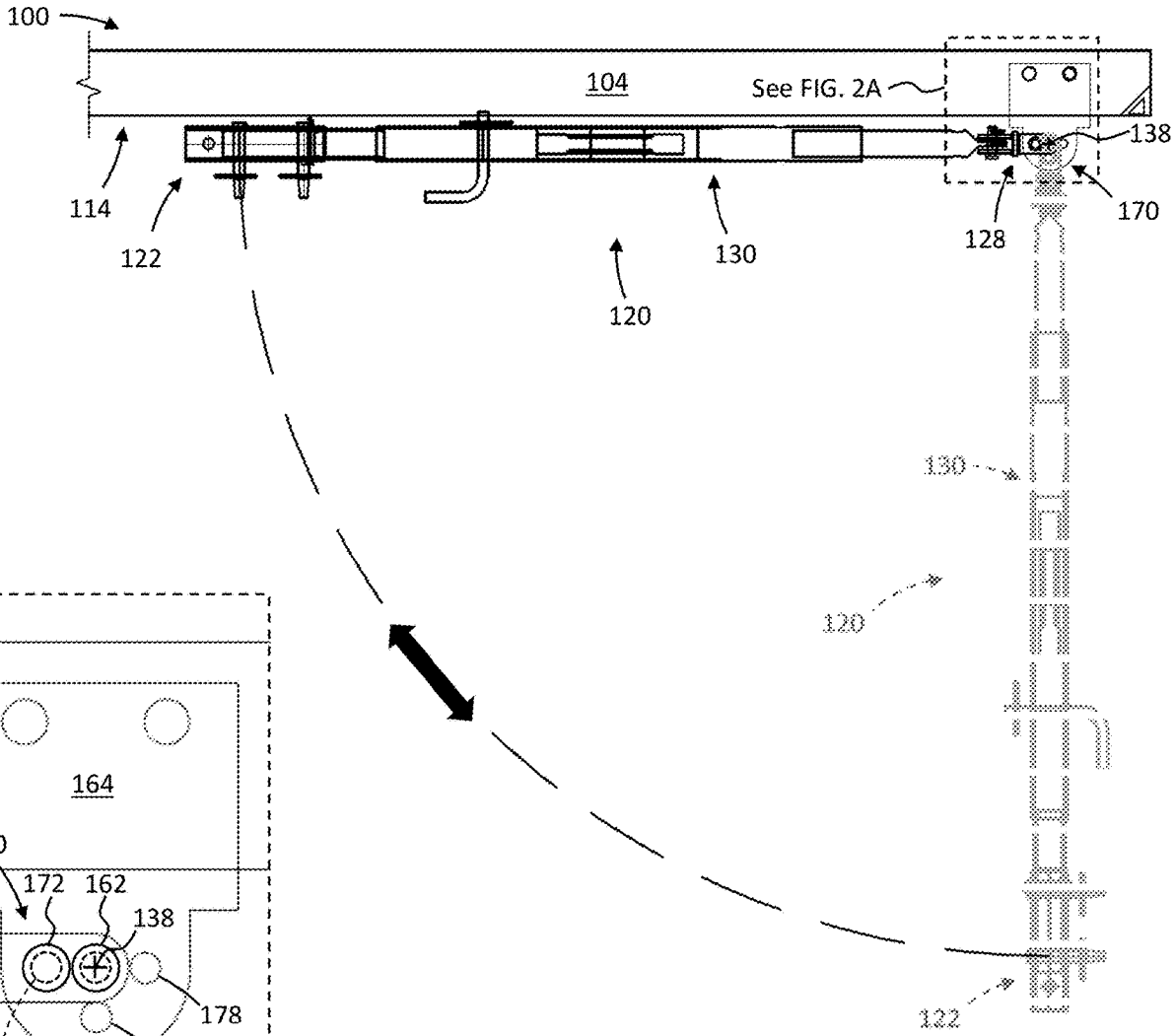
FIG. 2 is a top plan view of portions of the formwork system of FIG. 1, showing a brace assembly of the formwork system in deployed and storage configurations.

Referring to FIG. 2, in the example illustrated, the swivel connectors 128 are pivotable relative to the wallform panel 104 for swinging the brace assembly 120 between a deployed position (shown in FIG. 2 in dashed lines—see also FIG. 1) and at least one storage position (shown in FIG. 2 in solid lines). In the example illustrated, when in the deployed position, the brace assembly 120 projects from the second side 114 of the wallform panel 104 for anchoring the base plate 122 to the ground surface 124 and supporting the wallform panel 104 upright (see also FIG. 1). When in the storage position, the brace assembly 120 lies adjacent the wallform panel 104, with the base plate 122 and props 130 adjacent the second side 114. In the example illustrated, when in the deployed position, the brace assembly 120 extends generally perpendicular to the wallform panel 104, and when in the storage position, the brace assembly 120 extends generally parallel with the wallform panel 104. Referring to FIG. 1, in the example illustrated, the swivel connectors 128 are pivotable about a vertical axis 138 relative to the wallform panel 104, and the props 130 (and base plate 122) are fixed to pivot with the swivel connectors 128 about the vertical axis 138 for swinging the brace assembly 120 between the deployed and storage positions. Referring to FIG. 2, in the example illustrated, the deployed position and the storage position are offset from each other by about 90 degrees about the vertical axis 138.

Referring to FIG. 1, in the example illustrated, each prop 130 has a prop length measured along the prop axis 132 between the first end 134 and the second end 136 of the prop 130. In the example illustrated, the length of at least one of the props 130 is adjustable to facilitate alignment of the wallform panel 104 when the brace assembly 120 is anchored to the ground surface 124. In the example illustrated, each of the props 130 has an adjustable prop length, which can help provide for more flexibility in alignment of the wallform panel, for example, by allowing for more controlled translation and/or pivoting of the wallform panel when the base plate 122 is anchored.

In the example illustrated, each prop 130 comprises a length adjustment mechanism 146 for adjusting the prop length. In the example illustrated, the length adjustment mechanism comprises a turnbuckle mechanism, which can allow for infinite adjustment of the prop length over an adjustment distance. In the example illustrated, the turnbuckle mechanism comprises a first rod 148 extending along the prop axis 132 from the first end 134 of the prop 130 to a threaded end of the first rod 148, a second rod 150 extending along the prop axis 132 from the second end 136 of the prop 130 to a threaded end of the second rod 150 having an opposite handedness relative to the threaded end of the first rod 148, and a turnbuckle frame 152 between and threadingly receiving the threaded ends of the first and second rods 148, 150 at opposite ends of the frame 152. The turnbuckle frame 152 is rotatable about the prop axis 132 relative to the threaded ends of the first and second rods 148, 150 to adjust a spacing therebetween for adjustment of the prop length.

Referring to FIGS. 1A-1C, in the example illustrated, the first end 134 of each prop 130 is pivotably connected to the base plate 122 for pivoting about a corresponding first horizontal axis relative to the base plate 122, and the second end 136 of each prop 130 is pivotably connected to a corresponding swivel connector 128 for pivoting about a corresponding second horizontal axis relative to the swivel connector 128 to accommodate length adjustment of the props 130 for aligning the wallform panel 104.

Referring to FIG. 1C, in the example illustrated, the first end 134 of each prop 130 is pivotably connected to the base plate 122 through a corresponding first horizontal pivot pin 158. In the example illustrated, the first end 134 of each prop 130 and the base plate 122 have complementary horizontal pinholes for receiving corresponding first pivot pins 158 (i.e. one pin 158*a* for pivotably connecting the upper prop 130*a* to the base plate 122, and one pin 158*b* for pivotably connecting the lower prop 130*b* to the base plate 122). In the example illustrated, each first pivot pin 158 is removable for disconnecting the first end 134 of the corresponding prop 130 from the base plate 122.

Figure 5:
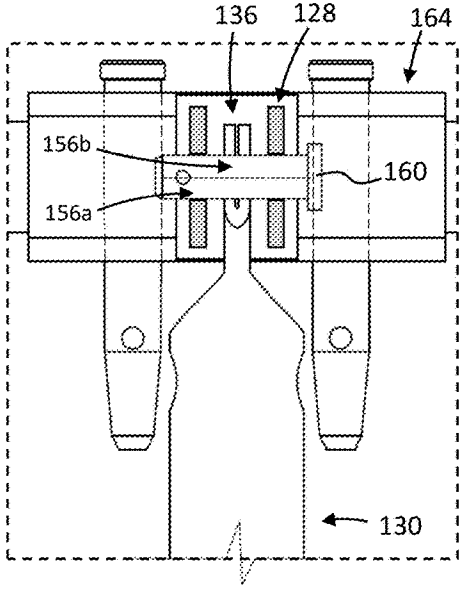
FIG. 5 is another cross-sectional view of the portions shown in FIG. 3, taken along line 5-5 in FIG. 3.

Referring to FIGS. 1A and 1B, in the example illustrated, the second end 136 of each prop 130 is pivotably connected to a corresponding swivel connector 128 through a corresponding second horizontal pivot pin 160. In the example illustrated, each swivel connector 128 and corresponding second end 136 of each prop 130 include complementary horizontal pinholes 156*a*, 156*b* (FIG. 5), respectively, for receiving a corresponding pivot pin 160 (i.e. one pin 160*a* for pivotably connecting the upper prop 130*a* to the upper swivel connector 128*a*, and one pin 160*b* for pivotably connecting the lower prop 130*b* to the lower swivel connector 128*b* in the example illustrated). In the example illustrated, each second pivot pin 160 is removable for disconnecting the second end 136 of the prop 130 from the corresponding swivel connector 128.

Referring to FIG. 3, in the example illustrated, each swivel connector 128 is pivotably connected to the wallform panel 104 through a vertical pivot pin 162 extending along the vertical axis 138 to facilitate pivoting of the swivel connector 128 (and brace assembly 120) about the vertical axis 138. In the example illustrated, a mount 164 is detachably secured (and fixed relative) to the frame 118 of the wallform panel 104, and the vertical pivot pin 162 passes through the swivel connector 128 and the mount 164 for pivotably connecting the swivel connector 128 to the wallform panel 104. In the example illustrated, each swivel connector 128 and corresponding mount 164 comprise complementary vertical pinholes 166*a*, 166*b* (FIG. 4), respectively, in alignment with the vertical axis 138 for receiving the vertical pivot pin 162.

Referring to FIG. 2, in the example illustrated, the formwork system 100 includes a locking mechanism 170 operable to selectively lock the brace assembly 120 relative to the wallform panel 104 in at least one of the storage position and the deployed position, and to selectively unlock the brace assembly 120 relative to the wallform panel 104 for swinging between the deployed and storage positions. In the example illustrated, the locking mechanism 170 is operable to lock the brace assembly 120 in the deployed position and in the storage position relative to the wallform panel 104.

Figure 2A:
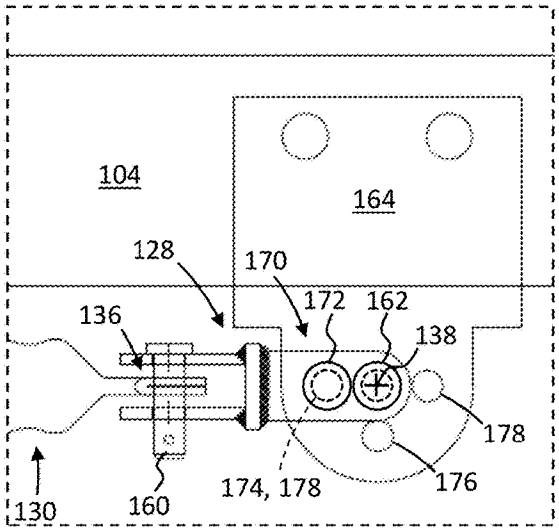
FIG. 2A is an enlarged view of a portion of FIG. 2.

In the example illustrated, the locking mechanism 170 is operable to lock the swivel connector 128 relative to the wallform panel 104 to inhibit pivoting of the swivel connector 128 (and the brace assembly 120) about the vertical axis 138 when the brace assembly 120 is in either of the deployed and storage positions. Referring to FIG. 2A, in the example illustrated, the locking mechanism 170 comprises a removable locking pin 172 (see also FIG. 3) insertable through a swivel aperture 174 (see also FIG. 3) in the swivel connector 128 and one of (i) a deployed-position aperture 176 fixed relative to the wallform panel 104 and in alignment with the swivel aperture 174 when the brace assembly 120 is in the deployed position, and (ii) at least one storage-position aperture 178 fixed relative to the wallform panel 104 and in alignment with the swivel aperture 174 when the brace assembly 120 is in the storage position (see also FIGS. 6 and 8).

In the example illustrated, each of the swivel aperture 174, the deployed-position aperture 176, and the storage-position aperture 178 extends parallel with and is spaced horizontally apart from the vertical axis 138, and the storage-position aperture 178 is spaced apart from the deployed-position aperture 176 by about 90 degrees about the vertical axis 138. In the example illustrated, the deployed-position and storage-position apertures 176, 178 are provided in the mount 164, and the locking mechanism 170 is operable to selectively lock the swivel connector 128 relative to the mount 164 for inhibiting pivoting of the swivel connector 128 about the vertical axis 138 to lock the brace assembly in either the deployed or storage positions. In the example illustrated, the locking mechanism 170 has two storage-position apertures 178 spaced apart from each other about the vertical axis by about 180 degrees, so that the brace assembly 120 can be moved to and locked in either of two storage positions (i.e. a first storage position offset from the deployed position by about 90 degrees in a clockwise direction about the vertical axis 138, and a second storage position offset from the deployed position by about 90 degrees in a counter-clockwise direction about the vertical axis 138).

Figure 8:
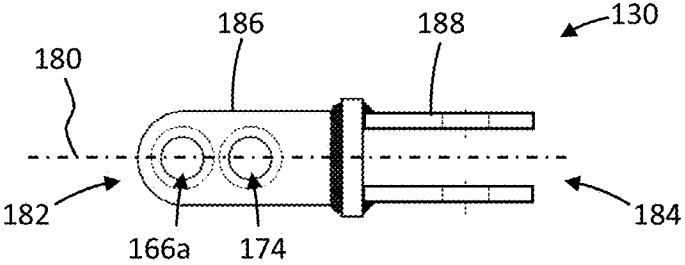
FIG. 8 is a top plan view of a swivel connector portion of the formwork system of FIG. 1.
Figure 9:
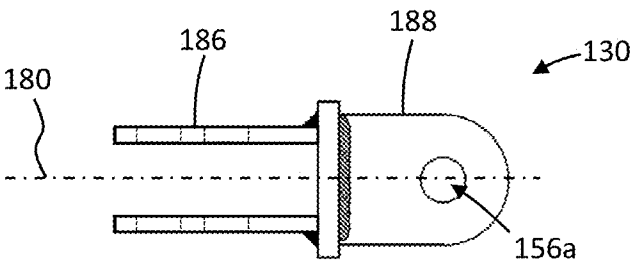
FIG. 9 is a side elevation view of the swivel connector portion of FIG. 8.

Referring to FIGS. 8 and 9, in the example illustrated, the swivel connector 128 extends along a swivel connector axis 180 between a connector first end 182 and a connector second end 184 opposite the connector first end 182. In the example illustrated, the swivel connector 128 has a first joint portion 186 at the connector first end 182 for connection to the mount 164, and a second joint portion 188 at the connector second end 184 for connection to the second end 136 of the prop 130. In the example illustrated, the first and second joint portions 186, 188 are fixed to each other. In the example illustrated, the vertical pinhole 166*a* (for receiving the vertical pivot pin) and the swivel aperture 174 (for the locking mechanism) pass through the first joint portion 186 and are spaced apart from each other along the swivel connector axis 180. In the example illustrated, the horizontal pinhole 156*a* of the swivel connector 128 (for receiving the second pivot pin to pivotably connect the prop) passes through the second joint portion 188. In the example illustrated, the first joint portion 186 comprises a first knuckle joint, and the second joint portion 188 comprises a second knuckle joint offset from the first knuckle joint by 90 degrees about the swivel connector axis 180. In the example illustrated, each of the first knuckle joint and the second knuckle joint comprises a double knuckle joint. Referring to FIG. 2A, in the example illustrated, the second end 136 of each prop 130 comprises a single knuckle joint received in the second (double) knuckle joint of the swivel connector 128 for connection to the second knuckle joint through the pivot pin 160.

Figure 6:
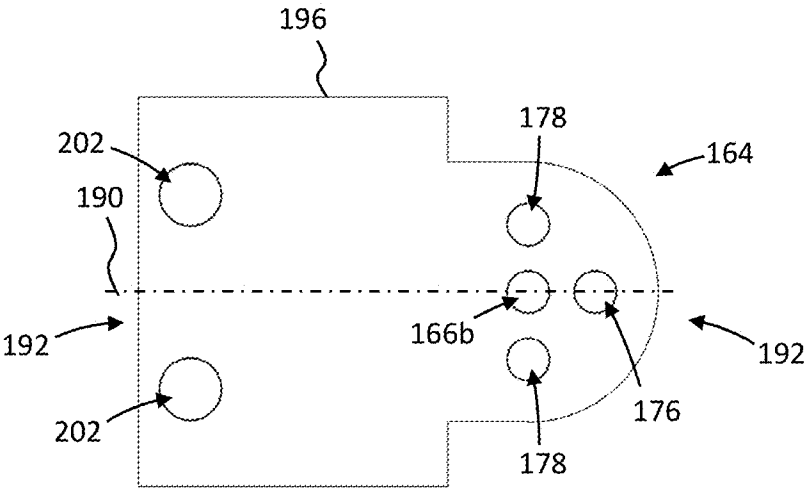
FIG. 6 is a top plan view of a mount portion of the formwork system of FIG. 1.
Figure 7:
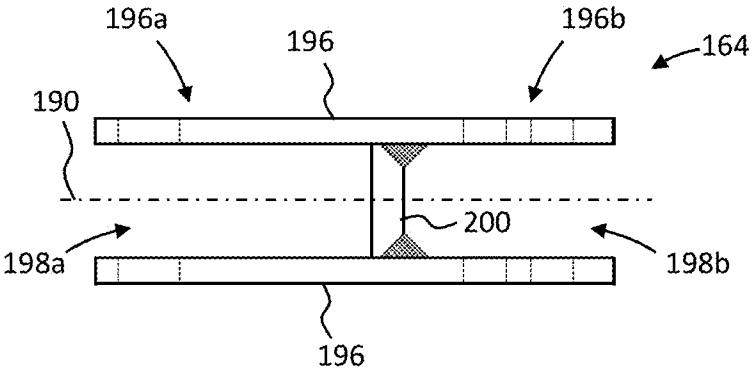
FIG. 7 is a side elevation view of the mount portion of FIG. 6.

Referring to FIGS. 6 and 7, in the example illustrated, the mount 164 extends along a mount axis 190 between a mount first end 192 and a mount second end 194. In the example illustrated, the mount 164 includes a pair of horizontal mount plates 196 spaced vertically apart by a plate spacing, and a cross plate 200 extending vertically between and connecting the mount plates 196. In the example illustrated, the cross plate 200 separates the plate spacing horizontally into a first channel 198*a* bounded vertically by a plate first portion 196*a* of the plates 196 and open to the mount first end 192, and a second channel 198*b* bounded vertically by a plate second portion 196*b* of the plates 196 and open to the mount second end 194.

In the example illustrated, the first channel 198*a* is sized to receive a corresponding frame member 118*a* (FIG. 3) of the wallform frame 118 (FIG. 3) in close fit, and the plate first portion 196*a* has a pair of mounting holes 202 passing vertically therethrough for receiving corresponding mounting pins 204 (FIG. 3) for engagement with the frame member 118*a* to secure the mount 164 thereto. In the example illustrated, the mount 164 is adapted for mounting the swivel connector 128 to a horizontally extending frame member 118*a* of the frame 118. In other examples, the mount can be adapted for mounting the swivel connector 128 to vertically extending frame members of the frame 118.

Figure 4:
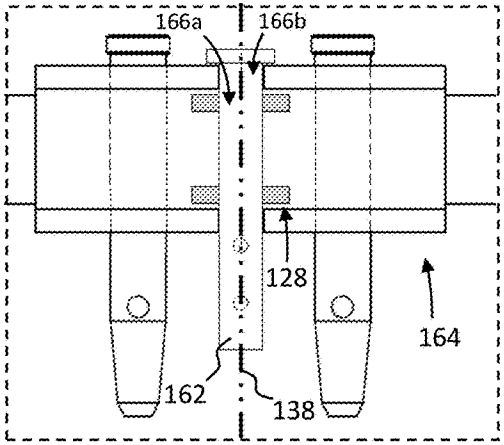
FIG. 4 is a cross-sectional view of the portions shown in FIG. 3, taken along line 4-4 of FIG. 3.

Referring to FIGS. 6 and 7, in the example illustrated, the vertical pinhole 166*b* passes through the plate second portion 196*b*. In the example illustrated, the second channel 198*b* is sized to receive the first joint portion 186 of the swivel connector 128 in close fit, with the vertical pinhole 166*a* of the swivel connector 128 in alignment with the vertical pinhole 166*b* of the mount 164 for receiving the vertical pivot pin 162 (FIG. 4). In the example illustrated, the deployed-position and storage-position apertures 176, 178 pass vertically through the plate second portion 196*b*.

Referring to FIGS. 1-2, in use, the formwork system 100 is deployed by positioning the wallform panel 104 upright and swinging the brace assembly 120 from the storage position to the deployed position. Prior to swinging the brace assembly 120 to the deployed position, the brace assembly 120 is unlocked through operation of the locking mechanism 170 (e.g. the locking pin 172 is removed from the swivel aperture 174 and one of the storage-position apertures 178).

When in the deployed position, the brace assembly 120 is locked relative to the wallform panel 104 through operation of the locking mechanism 170 (e.g. by inserting the locking pin 172 through the swivel aperture 174 and the deployed-position aperture 176), and the base plate 122 is anchored to the ground surface 124 using one or more anchors 126 (e.g. anchor bolts—FIG. 1C). When the base plate 122 is anchored, the prop length of at least one of the props 130 is adjusted to align the wallform panel 104.

After alignment, and with the panels 104, 106 tied together, the building material (e.g. concrete) is poured into the space 110 between the panels 104, 106. When the building material is sufficiently cured, the formwork system 100 can be taken down. The take down process includes unanchoring the base plate 122 from the ground surface 124, unlocking the brace assembly 120 from the deployed position if previously locked (e.g. by removing the locking pin 172 from the swivel aperture 174 and the deployed-position aperture 176), and swinging the brace assembly 120 back to the storage position.

When back in the storage position, the brace assembly 120 is locked relative to the wallform panel 104 (e.g. by inserting the locking pin 172 through the swivel aperture 174 and one of the storage-position apertures 178), and the formwork system 100 can be transported with the brace assembly 120 connected to the wallform panel 104 for storage or deployment at a different location to form another wall portion.

When used for forming walls in a multi-level building, the formwork system 100 can be temporarily stored in a perimeter protection area of the multi-level building when not in use (e.g. stored adjacent perimeter protection panels outboard of the active construction area). During such storage, the brace assembly 120 can be locked in the storage position and remain connected to the wallform panel 104, allowing for more convenient transport to a different location (e.g. to another level of the building) and more rapid deployment and take down (e.g. by not necessarily requiring reconnection and disconnection of the brace assembly 120 to and from the wallform panel 104).

The invention claimed is:

1. A formwork system, comprising:

a) a wallform panel having a first side for forming a concrete wall portion and a second side opposite the first side;

b) at least one brace assembly mounted to the second side of the wallform panel for supporting and aligning the wallform panel, the brace assembly including:

i) a base plate for anchoring to a ground surface spaced horizontally apart from the wallform panel, ii) a pair of vertically spaced apart swivel connectors pivotably mounted to the second side of the wallform panel for pivoting about a vertical axis relative to the wallform panel, and iii) a pair of vertically spaced apart props, each prop having an adjustable length between a first end and a second end, the first end of each prop pivotably connected to the base plate and the second end of each prop pivotably connected to a corresponding swivel connector, and the props fixed to pivot with the swivel connectors about the vertical axis for swinging the brace assembly between a deployed position, in which the brace assembly projects from the wallform panel for anchoring the base plate and supporting the wallform panel upright, and a storage position, in which the brace assembly lies adjacent the wallform panel.

2. The formwork system of claim 1, wherein each swivel connector is pivotably connected to the wallform panel through a vertical pivot pin extending along the vertical axis through the swivel connector and a mount detachably secured to a frame of the wallform panel.

3. The formwork system of claim 1, wherein the first end of each prop is pivotably connected to the base plate through a corresponding first horizontal pivot pin, and the second end of each prop is pivotably connected to a corresponding swivel connector through a corresponding second horizontal pivot pin.

4. The formwork system of claim 1, further comprising a locking mechanism operable to selectively lock the brace assembly in either of the deployed position and the storage position, and unlock the brace assembly for swinging between the deployed and storage positions.

5. The formwork system of claim 4, wherein the locking mechanism comprises a removable locking pin insertable through a swivel aperture in the swivel connector and one of (i) a deployed-position aperture fixed relative to the wallform panel and in alignment with the swivel aperture when the brace assembly is in the deployed position, and (ii) a storage-position aperture fixed relative to the wallform panel and in alignment with the swivel aperture when the brace assembly is in the storage position.

6. The formwork system of claim 1, wherein each prop comprises a turnbuckle mechanism for adjusting the length.

7. A brace assembly for supporting and aligning a wallform panel, comprising:

c) a base plate for anchoring to a ground surface spaced horizontally apart from the wallform panel;

d) a pair of vertically spaced apart swivel connectors pivotably connectable to the wallform panel for pivoting about a vertical axis relative to the wallform panel; and c) a pair of vertically spaced apart props, each prop extending between a first end connected to the base plate and a second end connected to a corresponding swivel connector, the props fixed to pivot with the swivel connectors about the vertical axis for swinging the brace assembly between a deployed position, in which the brace assembly projects from the wallform panel, and a storage position, in which the brace assembly lies adjacent the wallform panel, wherein at least one of the props has an adjustable length between the first and second ends.

8. The brace assembly of claim 7, wherein each swivel connector is pivotably connectable to the wallform panel through a vertical pivot pin passing through the swivel connector and a corresponding mount detachably securable to a frame of the wallform panel.

9. The brace assembly of claim 7, further comprising a locking mechanism operable to selectively lock the brace assembly in at least one of the deployed position and the storage position, and unlock the brace assembly for swinging between the deployed and storage positions.

10. The brace assembly of claim 9, wherein the locking mechanism is operable to selectively lock the brace assembly relative to the wallform panel in the deployed position and in the storage position.

11. The brace assembly of claim 7, wherein each swivel connector has a first joint portion pivotably connected to a mount detachably securable to a frame of the wallform panel for pivoting of the swivel connector about a vertical axis relative to the mount, and a second joint portion pivotably connected to the second end of a corresponding prop for pivoting of the prop about a horizontal axis relative to the swivel connector and for pivoting of the prop with the swivel connector about the vertical axis relative to the mount to swing the brace assembly between the deployed and storage positions.

12. The brace assembly of claim 11, wherein the swivel connector is pivotably connected to the mount through a vertical pivot pin extending along the vertical axis.

13. The brace assembly of claim 11, further comprising a locking mechanism operable to selectively lock the swivel connector relative to the mount for inhibiting pivoting of the swivel connector about the vertical axis when the brace assembly is in the deployed position and when the brace assembly is in the storage position, and to unlock the swivel connector relative to the mount to permit swinging of the brace assembly between the deployed and storage positions.

14. The brace assembly of claim 11, wherein the locking mechanism comprises a removable locking pin insertable through a swivel aperture in the swivel connector and one of (i) a deployed-position aperture in the mount and in alignment with the swivel aperture when the brace assembly is in the deployed position, and (ii) a storage-position aperture in the mount and in alignment with the swivel aperture when the brace assembly is in the storage position.

15. The swivel apparatus of claim 14, wherein each of the swivel aperture, the deployed-position aperture, and the storage-position aperture extends parallel with and is spaced horizontally apart from the vertical axis.

16. The swivel apparatus of claim 15, wherein the storage-position aperture is spaced apart from the deployed-position aperture by about 90 degrees about the vertical axis.

17. A method of operating a formwork system, comprising:

a) positioning the formwork system upright, the formwork system comprising a wallform panel and a brace assembly pivotably connected to the wallform panel, the brace assembly including a pair of vertically spaced apart props, each prop having a first end pivotably connected to the wallform panel and a second end connected to a base plate of the brace assembly;

b) swinging the brace assembly relative to the wallform panel from a storage position to a deployed position;

c) when the brace assembly is in the deployed position, anchoring the base plate to a ground surface spaced apart from the wallform panel;

d) after (c), adjusting a length of at least one of the props to align the wallform panel;

e) after (d), unanchoring the base plate from the ground surface;

f) after (e), swinging the brace assembly from the deployed position back to the storage position.

18. The method of claim 17, further comprising: prior to (b), unlocking the brace assembly from the storage position; prior to (c), locking the brace assembly in the deployed position; prior to (f), unlocking the brace assembly from the deployed position; and after (f), locking the brace assembly in the storage position.

19. The method of claim 17, after (f), transporting the formwork system with the brace assembly in the storage position and pivotably connected to the wallform panel to a different location, and repeating steps (a) to (f) at the different location.

* * * * *